US008869676B2

(12) United States Patent
Townsend et al.

(10) Patent No.: US 8,869,676 B2
(45) Date of Patent: Oct. 28, 2014

(54) FABRIC FLUID-POWERED CYLINDER

(75) Inventors: Phillip Lynn Townsend, Spring, TX (US); Gary Dale Krch, Friendswood, TX (US)

(73) Assignee: Utilequip, Inc., Houston, TX (US)

( * ) Notice: Subject to any disclaimer, the term of this patent is extended or adjusted under 35 U.S.C. 154(b) by 1084 days.

(21) Appl. No.: 12/566,095

(22) Filed: Sep. 24, 2009

(65) Prior Publication Data

US 2010/0071544 A1 Mar. 25, 2010

Related U.S. Application Data

(60) Provisional application No. 61/100,070, filed on Sep. 25, 2008.

(51) Int. Cl.
*F04B 43/08* (2006.01)
*F15B 15/10* (2006.01)

(52) U.S. Cl.
CPC ..... *F15B 15/10* (2013.01)
USPC ..... 92/13.1; 92/13.2; 92/92

(58) Field of Classification Search
USPC ..... 92/13.1, 13.2, 90–92, 89, 93
See application file for complete search history.

(56) References Cited

U.S. PATENT DOCUMENTS

| | | | | | |
|---|---|---|---|---|---|
| 3,438,309 | A * | 4/1969 | Boileau | 92/103 R |
| 3,805,669 | A * | 4/1974 | Mitchell | 92/13.1 |
| 4,721,030 | A * | 1/1988 | Paynter | 92/92 |
| 5,014,600 | A * | 5/1991 | Krauter et al. | 92/92 |
| 5,158,005 | A * | 10/1992 | Negishi et al. | 92/92 |
| 5,201,262 | A * | 4/1993 | Negishi et al. | 92/92 |
| 5,251,538 | A * | 10/1993 | Smith | 92/92 |
| 6,460,836 | B1 * | 10/2002 | Trowbridge | 267/64.27 |
| 7,213,503 | B2 * | 5/2007 | Asai et al. | 92/92 |
| 2002/0108491 | A1 * | 8/2002 | Stahn | 92/92 |
| 2009/0301292 | A1 * | 12/2009 | Kothera et al. | 92/90 |

FOREIGN PATENT DOCUMENTS

| | | | |
|---|---|---|---|
| JP | 0324304 | A | 2/1991 |
| JP | 6005081 | A | 1/1994 |
| JP | 6126681 | A | 5/1994 |
| JP | 2961320 | B2 | 8/1999 |
| KR | 100403304 | B1 | 2/2004 |

* cited by examiner

*Primary Examiner* — F. Daniel Lopez
(74) *Attorney, Agent, or Firm* — Chamberlain Hrdlicka

(57) ABSTRACT

A fluid-powered cylinder for displacing an object with respect to a support surface is disclosed. The fluid-power cylinder includes a fabric enclosure having ends fastened to two end caps and forming an expandable and contractible chamber therein. The chamber has a port for selectively disposing an incompressible fluid in the chamber. The chamber is adapted to displace the object to a first position with respect to the support surface and to displace the object to a second position with respect to the support surface.

31 Claims, 13 Drawing Sheets

FABRIC FLUID-POWERED CYLINDER

CROSS-REFERENCE TO RELATED APPLICATIONS

This application claims benefit of U.S. provisional application Ser. No. 61/100,070 filed on Sep. 25, 2008, and entitled "Fabric Fluid-Powered Cylinder," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

1. Field of the Invention

The present invention relates generally to pneumatic and hydraulic cylinders and, more particularly, to a fabric fluid-powered cylinder.

2. Description of Related Art

Pneumatic and hydraulic cylinders generally include a rigid housing having dimensions and weight that limit the range of locations where such cylinders may be used and stored. Also, depending on the loads for which these cylinders are designed, and thus, their overall size, often these cylinders are not easily portable or designed to be portable from one operation site to the next. For those cylinders that are portable, such as a jack for a car, their capacity for lifting and range of extension is limited.

Thus, there exists a need for a flexible fluid-powered cylinder that may be transported to an operation site in a collapsed state, expanded at the operation site to displace an object, subsequently refracted to lower the object when desired, and collapsed when empty to minimize storage requirements. It would be particularly advantageous if the fluid-powered cylinder had minimal weight to reduce associated transportation costs and facilitate its positioning for use, and was nonconductive to protect the object from electrical hazards.

SUMMARY OF THE PREFERRED EMBODIMENTS

An apparatus for displacing an object is disclosed. In some embodiments, the apparatus includes a fabric enclosure having ends fastened to two end caps and forming an expandable and contractible chamber therein. The chamber has a port for selectively disposing an incompressible fluid in the chamber. The chamber is adapted to displace the object to a first position with respect to the support surface and to displace the object to a second position with respect to the support surface.

In some embodiments, the apparatus includes a first end cap assembly and a second end cap assembly, a sleeve disposed therebetween, and a closeable fluid port extending through one of the first and the second end cap assemblies. The sleeve comprises fabric and is coated over an inner surface, thereby forming a bladder that is impermeable to fluid. The fluid port is configured to allow fluid communication with the bladder.

Some methods for displacing an object with respect to a support surface include positioning an expandable/contractible enclosure between the object and support surface, injecting a fluid through a fluid port in the expandable/contractible enclosure to expand the expandable/contractible enclosure, guiding the expansion of the expandable/contractible enclosure in a longitudinal direction, extending the sleeve as fluid accumulates in the expandable/contractible enclosure, and displacing the object from a first position to a second position as the expandable/contractible enclosure expands.

Thus, the enclosure comprises a combination of features and advantages that enable it to provide a high-strength, yet lightweight fluid-powered lifting or displacing apparatus. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

NOTATION AND NOMENCLATURE

Figure 1B:
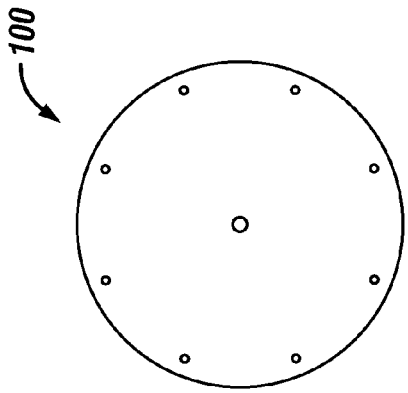
FIGS. 1A, 1B and 1C are side, end and cross-sectional views, respectively, of a fabric fluid-powered cylinder in accordance with the principles disclosed herein.

Certain terms are used throughout the following description and claims to refer to particular system components. This document does not intend to distinguish between components that differ in name but not function. Moreover, the drawing figures are not necessarily to scale. Certain features of the invention may be shown exaggerated in scale or in somewhat schematic form, and some details of conventional elements may not be shown in the interest of clarity and conciseness.

In the following discussion and in the claims, the term "comprises" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

Figure 1C:
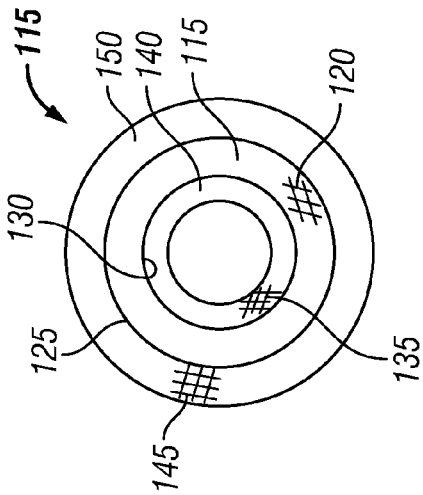
Figure 1A:
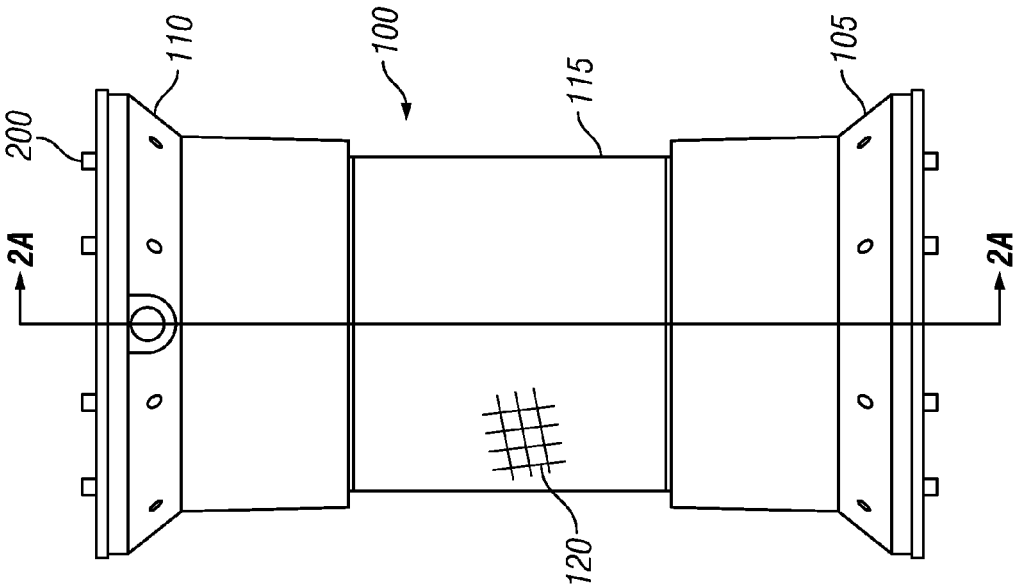

Referring to FIGS. 1A and 1B, there are shown side and end views, respectively, of an embodiment of a fabric fluid-powered cylinder (hereinafter "cylinder") 100 for displacing an object. Cylinder 100 includes two end cap assemblies 105, 110 with a pressure sleeve 115 extending therebetween. In some embodiments, pressure sleeve 115 has a generally cylindrical and preferably seamless shape. The dimensions of pressure sleeve 115, such as its diameter and length, are selected depending on the environment in which cylinder 100 is to be used and/or the weight and size of objects to be displaced by cylinder 100. For particular applications where minimal space exists for placement of cylinder 100, for example, its diameter may be relatively small. On the other hand, for applications where large, heavy objects are to be displaced, the diameter of cylinder 100 may be significantly larger.

Pressure sleeve 115 is preferably made of a braided fabric 120. Alternatively, fabric 120 of pressure sleeve 115 may be woven, knitted or constructed by other fabric-forming methods known in the industry. Fabric 120 is high-strength, while at the same time, lightweight. Thus, pressure sleeve 115 has the structural capacity to contain high-pressure fluids, both liquids and gases. The thickness and other properties of fabric 120 may be tailored as a function of the weight of the fluid pressure to be contained within cylinder 100. Pressure sleeve 115 has minimal weight, which facilitates handling and reduces transportation costs for moving cylinder 100 between storage and usage locations.

Fabric 120 of pressure sleeve 115 is tear-resistant. As such, cylinder 100 may be stowed in virtually any orientation, including on its side, without risk of damage. Fabric 120 is flexible or pliable and allows cylinder 100 to collapse when empty, thereby occupying only a fraction of the storage space required when cylinder 100 is extended to displace an object.

As best viewed in FIG. 1C, pressure sleeve 115 includes an outer surface 125 and an inner surface 130, both of which are coated Inner surface 130 is coated with a material 135 to form a bladder 140. Alternatively, bladder 140 may be formed by a separate sleeve inserted into pressure sleeve 115 and secured therein. Bladder 140 enables pressure sleeve 115 to be impermeable to materials disposed therein and enables pressure sleeve 115 to contain fluid, either gas or liquid, including pressurized gases or inert gases. Further, material 135 of bladder 140 may be selected such that it adheres well to the fibers of fabric 120 and is compatible with the expected range of fluids to be introduced to cylinder 100. Outer surface 125 of pressure sleeve 115 is coated with a material 145 to form a coating 150. Coating 150 prevents environmental damage to pressure sleeve 115 from ultraviolet light radiation, ozone in the atmosphere, weather in general, and abrasion during handling of cylinder 100.

In some embodiments, material 135 of bladder 140 over inner surface 130 may be different than material 145 of coating 150 over outer surface 125. However, in preferred embodiments, materials 135, 145 both include polyurethane. A suitable polyurethane has an adhesive property which enables it to adhere to fabric 120 of pressure sleeve 115. Further, polyurethane can stretch and deform without cracking. Thus, pressure sleeve 115 may be extended and collapsed repeatedly without damage to either bladder 140, resulting in loss of or diminished pressure-containment ability of cylinder 100, or coating 150, leaving pressure sleeve 115 susceptible to damage from environmental sources. Other materials having functionally equivalent properties to polyurethane may be alternatively used.

Fabric 120 of pressure sleeve 115 preferably includes braided Vectran® made by Kuraray or high performance polyaramids, such as Kevlar®, with axially-oriented fibers of grade E fiberglass, or e-glass. Vectran® is a manufactured fiber spun from a liquid crystal polymer. Vectran® is noted for its high strength, thermal stability at high temperatures, abrasion resistance, low density, low creep, low electrical conductivity and chemical stability. Vectran® has a tensile strength as high as 3.2 GPa, which is generally five times the strength of typical steel and ten times the strength of aluminum. The abrasion resistance of Vectran® is ten times more than that of competing aramid fibers, as measured by Cordage Institute Test Method CI-1503. Vectran® has a density approximately equal to 1.4 gm/cc. By comparison, the approximate densities of aluminum and stainless steel are 2.8 gm/cc and 7.4 gm/cc, respectively. Further, Vectran® is resistant to moisture and ultraviolet radiation. When combined, e.g., interwoven, with braided or woven Vectran®, e-glass stablizes the Vectran® and prevents the Vectran® from unraveling. Also, like Vectran®, e-glass has high strength and is lightweight. While fabric 120 of pressure sleeve 115 preferably includes Vectran® and e-glass, other materials, either individually or in combination, having functionally equivalent properties may be used instead.

Figure 2B:
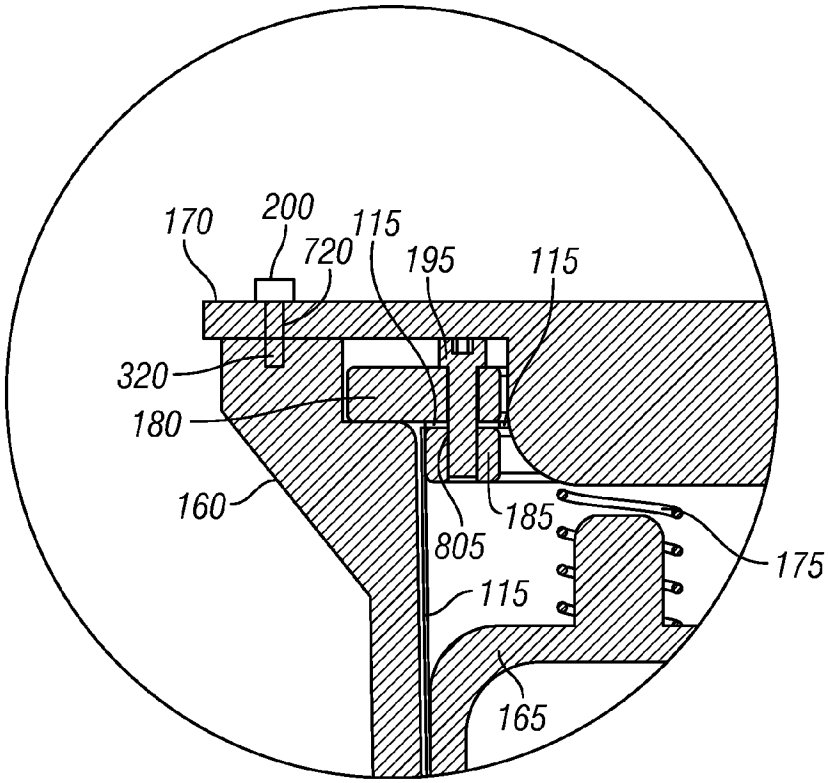
FIGS. 2A and 2B are a cross-sectional and enlarged cross-sectional views, respectively, of the fluid-powered cylinder of FIG. 1A.
Figure 2A:
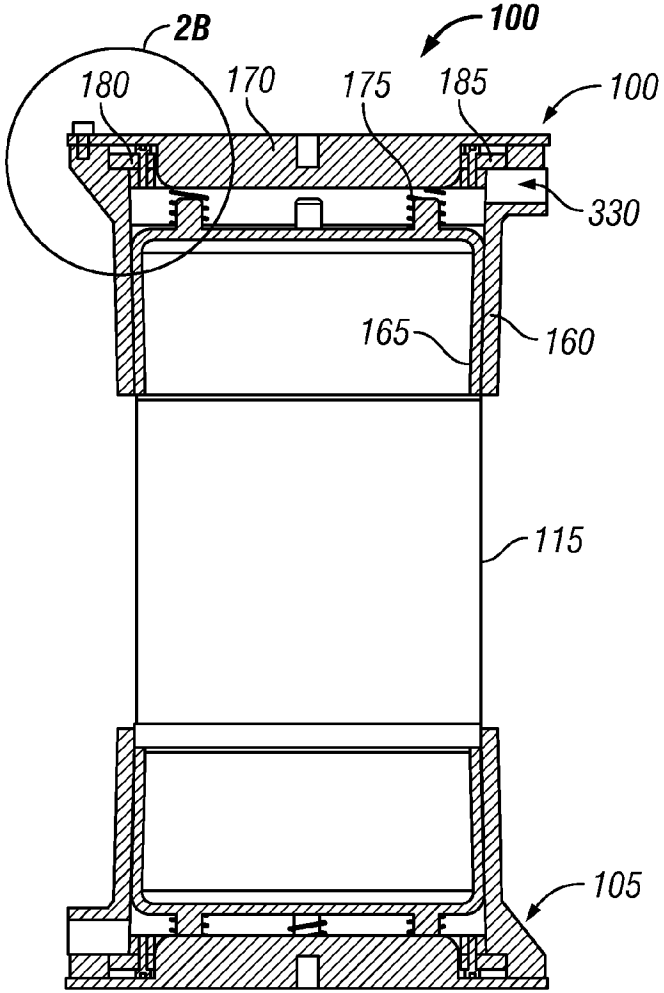

Turning now to FIGS. 2A and 2B, end cap assemblies 105, 110 are substantially identical in this exemplary embodiment. For the sake of brevity, end cap assembly 110 is now described. However, this description also applies to end cap assembly 105. End cap assembly 110 includes a collet collar 160, a collet plug 165 inserted therein, a cap 170, one or more compressible biasing members 175, for example, springs, disposed between plug 165 and cap 170, an inner clamping ring 185, and an clamping outer ring 180.

Figure 3A:
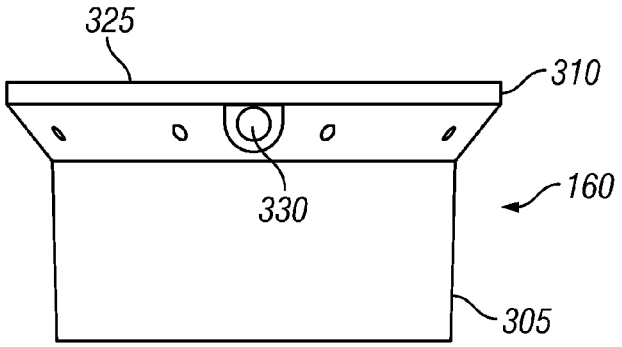
FIG. 3A-3C are side, end and cross-sectional views, respectively, of the collet collar of the fluid-powered cylinder of FIG. 1A.
Figure 3B:
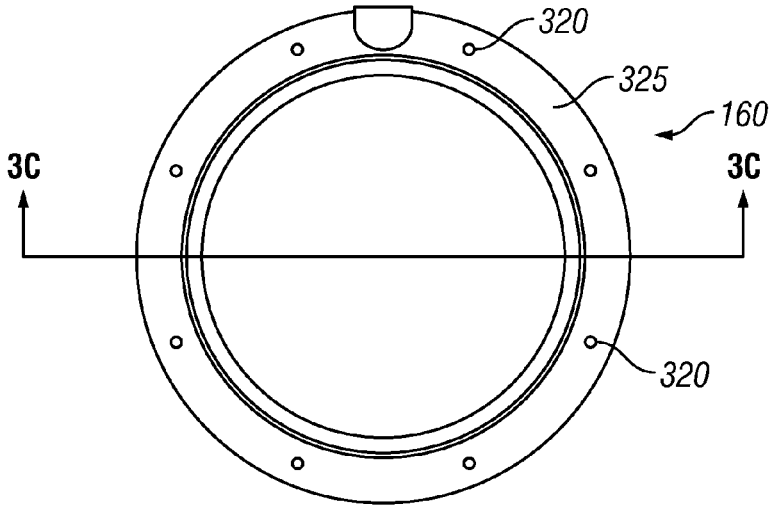
Figure 3C:
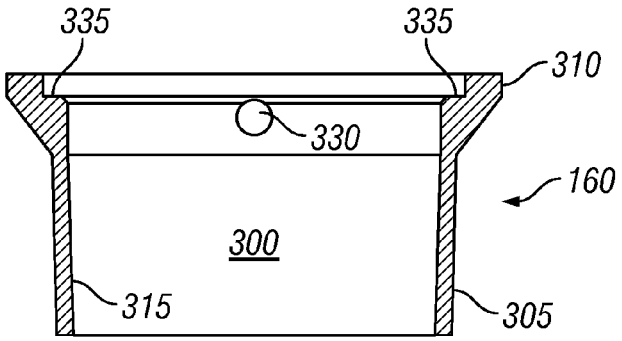

Referring next to FIGS. 3A-3C, collet collar 160 is generally tubular in shape, having a central bore 300 extending between a first end 305 and a second, flanged end 310. The inner diameter of collet collar 160 at first end 305 is less than the inner diameter of collet collar 160 at flanged end 310. Thus, collet collar 160 has a tapered, conical shaped inner surface 315. Collet collar 160 further includes a fluid port 330, a plurality of threaded bores 320 spaced circumferentially about an outer surface 325 of flanged end 310, and a shoulder 335 disposed in inner surface 315 formed by a counterbore portion 360 proximate flanged end 310. As will be described below, threaded bores 320 enable coupling of cap 170 to collet collar 160. Fluid port 330 extends through flanged end 310 of collet collar 160 and enables injection of fluid into and/or flow of fluid from cylinder 100.

Figure 4A:
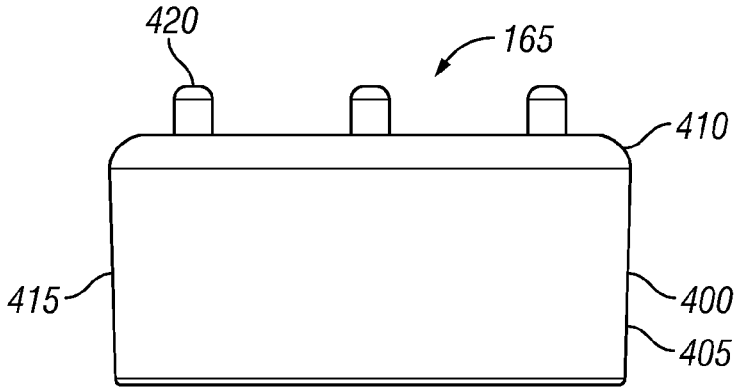
FIGS. 4A-4C are side, end and cross-sectional views, respectively, of the collet plug of the fluid-powered cylinder of FIG. 1A.
Figure 4B:
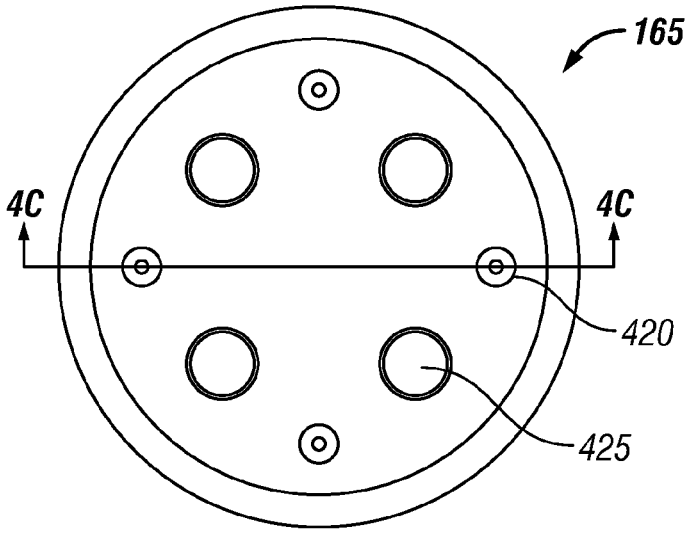
Figure 4C:
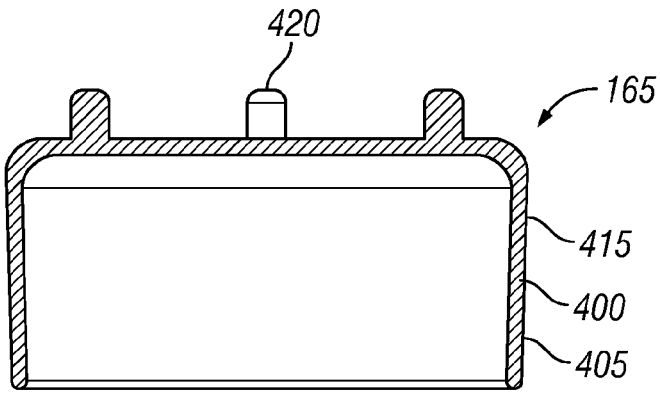

Turning to FIGS. 4A-4C, collet plug 165 is also conical in shape, having a body 400 disposed between an open end 405 and a closed end 410. The outer diameter of plug 165 at open end 405 is less than the outer diameter of plug 165 at closed end 410. Thus, body 400 has a tapered outer surface 415. Closed end 410 of plug 165 includes one or more extensions 420 projecting in a substantially normal direction therefrom and one or more flowbores 425 through end 410 between extensions 420. Each extension 420 is configured to receive a biasing member 175 (FIG. 1A), such as a spring, thereon, and in this exemplary embodiment, are generally cylindrical in shape. Flowbores 425 permit fluid flow therethrough.

Figure 5A:
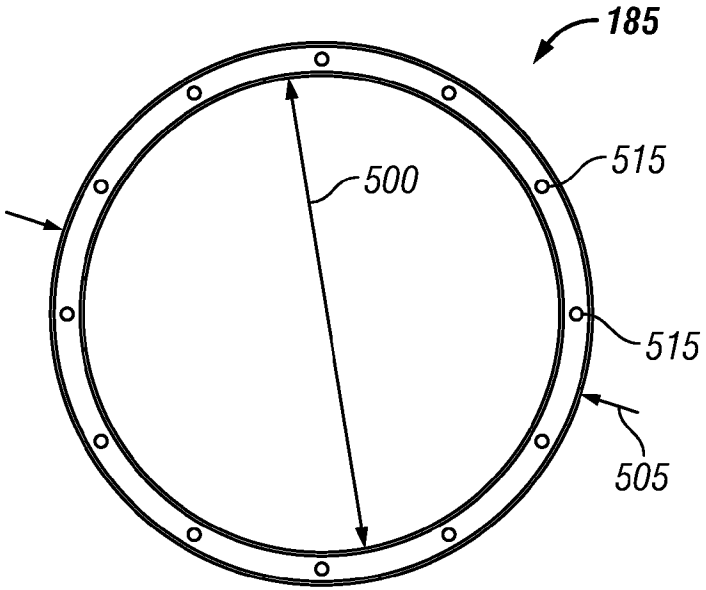
FIGS. 5A and 5B are end and side views, respectively, of the inner clamping ring of the fluid-powered cylinder of FIG. 1A.
Figure 5B:
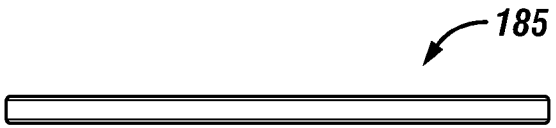

Referring now to FIGS. 5A and 5B, inner clamping ring 185 is circular in shape, having an inner diameter 500, an outer diameter 505, and a plurality of threaded bores 515 azimuthally spaced around its periphery. Outer diameter 505 is selected to enable insertion of inner clamping ring 185 into central bore 300 of collet collar 160, as shown in FIGS. 2A and 2B Inner diameter 500 is selected to enable cap 170 to be inserted at least partially therein, also as shown in FIGS. 2A and 2B. Threaded bores 515 enable the coupling of inner and outer clamping rings 185, 180 with pressure sleeve 115 secured therebetween, as shown in FIG. 2B and described in more detail below.

Figure 6A:
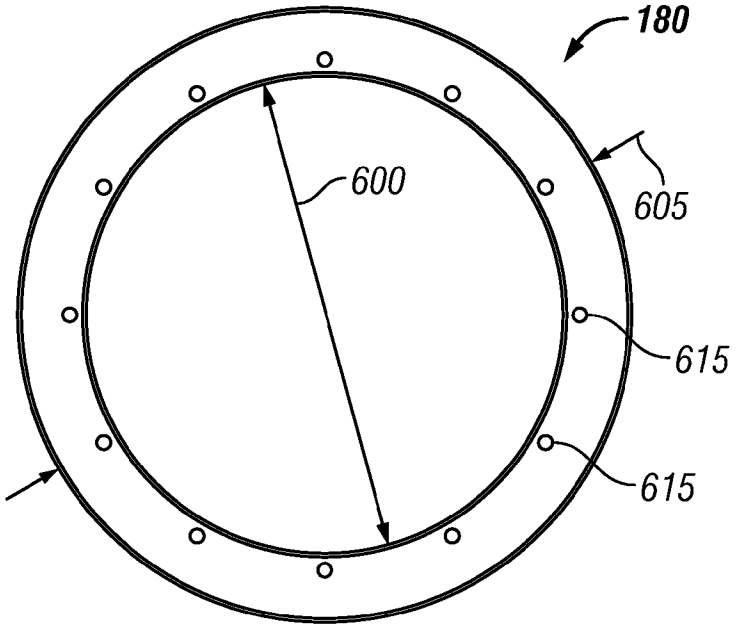
FIGS. 6A and 6B are end and side views, respectively, of the outer clamping ring of the fluid-powered cylinder of FIG. 1A.
Figure 6B:
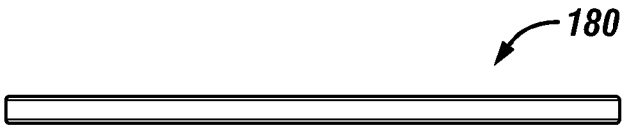

Turning to FIGS. 6A and 6B, outer clamping ring 180 is also circular in shape, having an inner diameter 600, an outer diameter 605, and a plurality of throughbores 615 azimuthally spaced around its inner diameter 600. Outer diameter 605 is selected to enable outer clamping ring 180 to be inserted into counterbore 360 of flanged end 310 of collet collar 160 and seated on shoulder 335 of collet collar 160, as shown in FIGS. 2A and 2B Inner diameter 600 is selected to enable cap 170 to be inserted at least partially therein, also as shown in FIGS. 2A and 2B. Throughbores 615 of outer clamping ring 180 align with threaded bores 515 of inner clamping ring 185 when clamping rings 180, 185 are assembled within collet collar 160. When so aligned, a plurality of threaded bolts 195 (FIG. 2A) are inserted through bores 615 of outer clamping ring 180, an end of pressure sleeve 115, sandwiched between outer and inner clamping rings 180, 185, and threaded into bores 515, as shown in FIG. 2B.

Figure 7A:
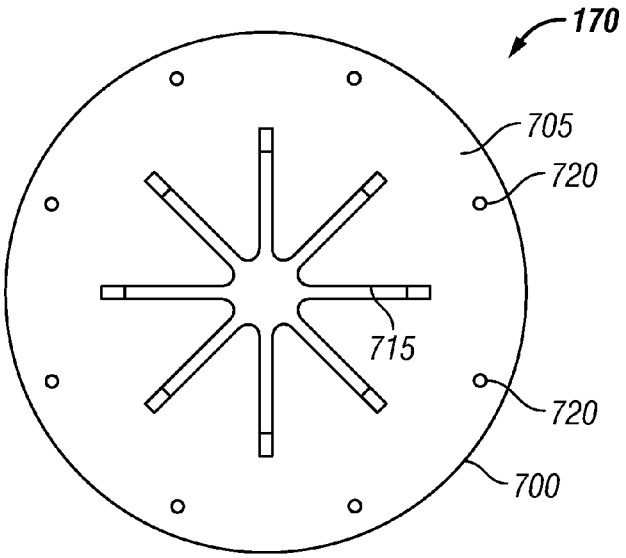
FIGS. 7A-7C are interior end, exterior end and side views, respectively, of the cap of the fluid-powered cylinder of FIG. 1A.
Figure 7B:
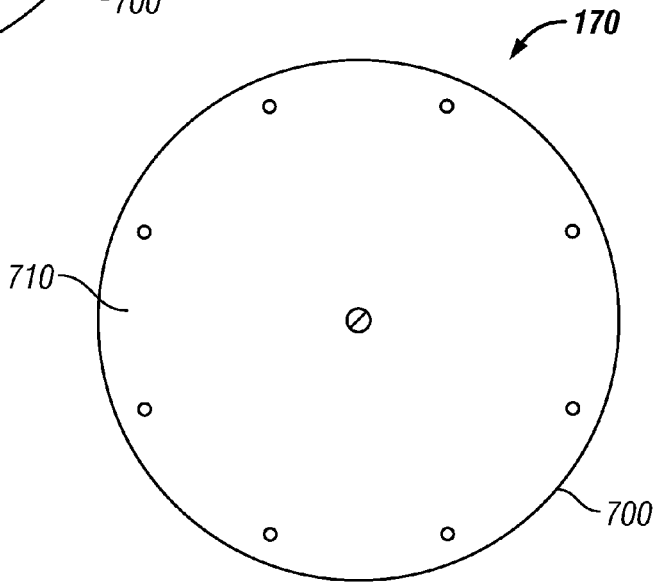
Figure 7C:
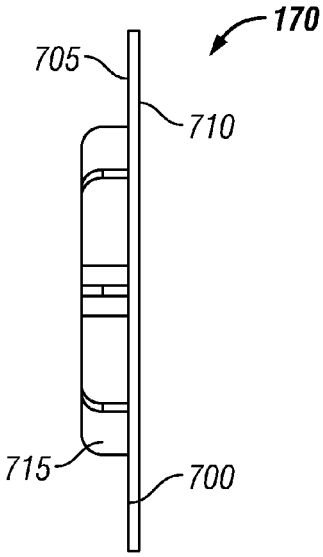

Referring to FIGS. 7A-7C, cap 170 includes a circular plate 700 having an inner surface 705, an outer surface 710, a plurality of stiffening members or ribs 715 coupled, such as by welding, to inner surface 705 and extending substantially normal therefrom, and a plurality of threaded bores 720 azimuthally spaced around its circumference. Ribs 715 are configured to promote the structural integrity of plate 700 and prevent plate 700 from bending or flexing when assembled with the remaining components of end cap assembly 110. Threaded bores 720 of cap 170 align with threaded bores 320 (FIG. 3A) of collet collar 160 when cap 170 is assembled with collet collar 160, as shown in FIG. 2B. When so aligned, a plurality of threaded bolts 200 are inserted through bores 720 and threaded into bores 320 to couple cap 170 to collet collar 160.

Figure 8A:
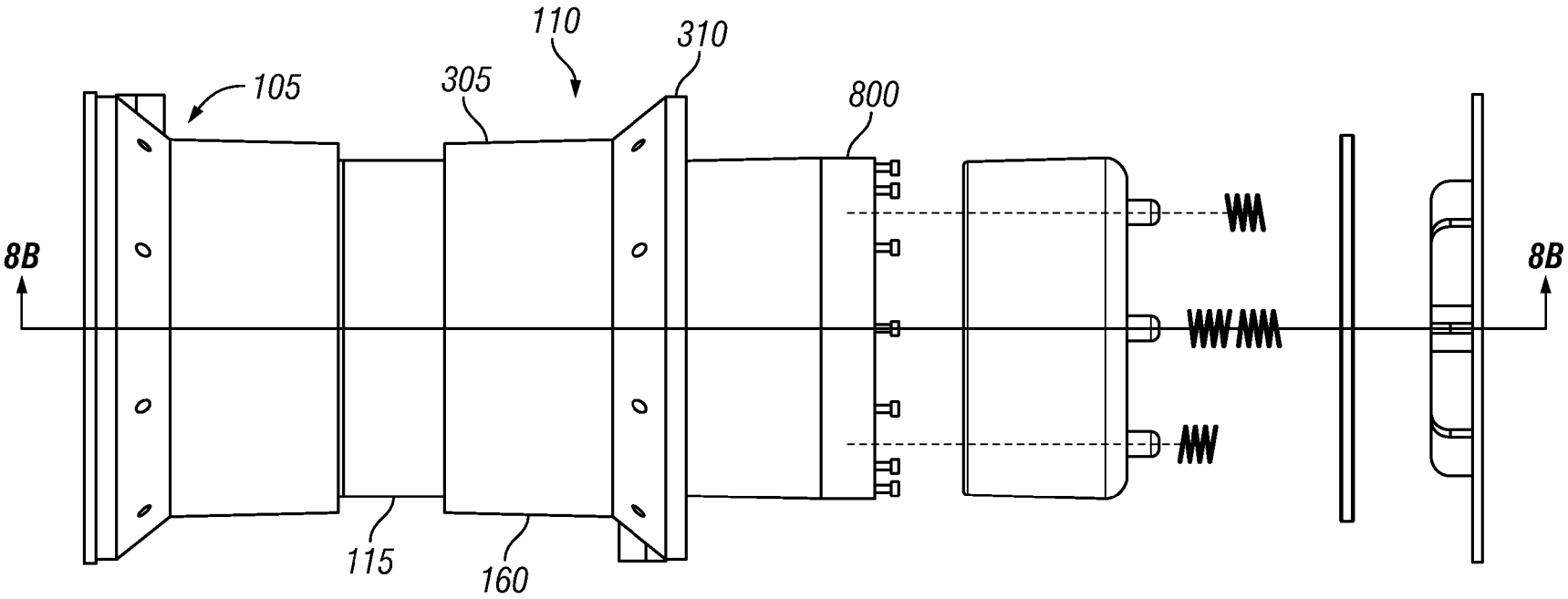
FIGS. 8A and 8B are exploded, side and exploded cross-sectional side views, respectively, of the fluid-powered cylinder of FIG. 1A.
Figure 8B:
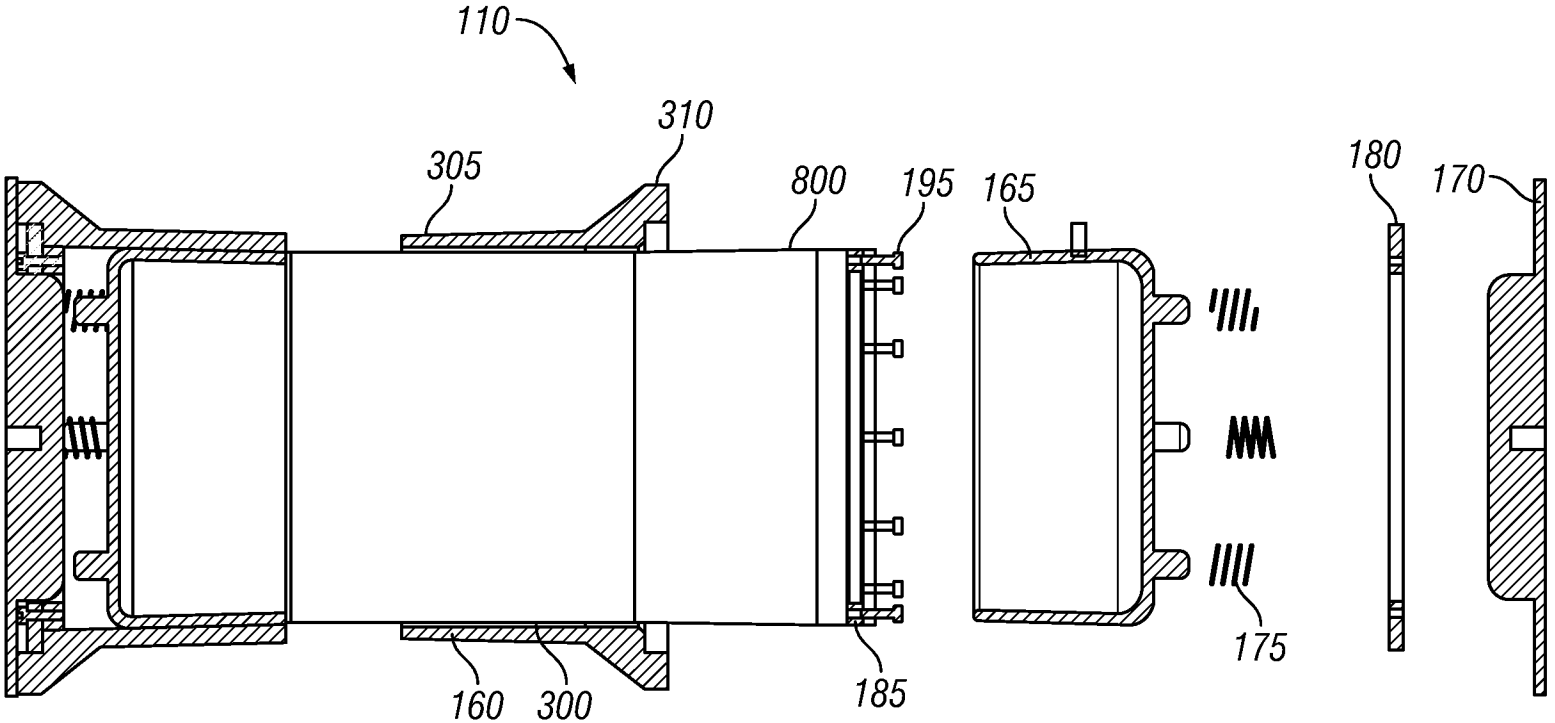

The assembly of cylinder 100 is best described with initial reference to FIGS. 8A and 8B, which are exploded, side views of cylinder 100, the latter in cross-section. Pressure sleeve 115 is first coated prior to assembly of cylinder 100 in order to protect outer surface 125 and form bladder 140 along inner surface 130. To assemble cylinder 100, end cap assembly 110 is coupled to pressure sleeve 115. An end 800 of pressure sleeve 115 is inserted through end 305 of collet collar 160 such that end 800 extends from throughbore 300 beyond flanged end 310. Collet plug 165 is then inserted into the pressure sleeve 115. Inner clamping ring 185 is then inserted within end 800 of pressure sleeve 115, as shown in FIGS. 8B and 2B. Turning now to FIG. 2B, end 800 is folded over inner clamping ring 185. Outer clamping ring 180 is then positioned over folded end 800 of pressure sleeve 115 against inner clamping ring 185 such that bores 615 (FIG. 6A) of outer clamping ring 180 align with threaded bores 515 (FIG. 5A) of inner clamping ring 185. Apertures 805 (FIG. 2B) are made in end 800 of pressure sleeve 115 to receive bolts 195 (FIG. 2B). When outer clamping ring 180 is aligned with inner clamping ring 185 in this manner, bolts 195 are then inserted through bores 615 of outer clamping ring 180 and end 800 of pressure sleeve 115 and threaded into bores 515 of inner clamping ring 185. Once bolts 195 are installed in this manner, end 800 of pressure sleeve 115 is securely sandwiched between clamping rings 180, 185 and may not come loose from this coupling.

Outer clamping ring 180, with pressure sleeve 115 and inner clamping ring 185 coupled thereto, is then seated on shoulder 335 of collet collar 160. Collet plug 165 is then positioned in pressure sleeve 115 and collet collar 160, as shown in FIG. 2A. Tapered inner surface 315 of collet collar 160 limits the depth to which plug 165 is insertable within collet collar 160 and enables a snug fit of plug 165 with collar 160 with pressure sleeve 115 sandwiched therebetween.

Next, cap 170 is assembled to collet collar 160 over collet plug 165. Springs 175 are installed over extensions 420 of plug 165, and cap 170 is positioned against flanged end 310 of collet collar 160, such that ribs 715 of cap 170 are disposed between extensions 420, bores 720 of cap 170 are aligned with threaded bores 320 on flanged end 310, and springs 175 are compressed between plug 165 and cap 170. Cap screws 200 are then inserted through bore 720 and threaded into bores 320 to couple cap 170 to collet collar 160. Lastly, end cap assembly 105 is coupled to pressure sleeve 115 following substantially the same steps to complete assembly of cylinder 100.

Once installed, springs 175 expand against plug 165, and thus provide a continual load against plug 165 in the absence of an internal pressure load from fluid within cylinder 100. During operation of cylinder 100, fluid is injected through port 330 of collet collar 160 into the inner chamber of cylinder 100. As fluid pressure within cylinder 100 increases, pressure sleeve 115 is gripped along two interfaces, one between tapered collet collar 160 and collet plug 165 and the other between clamping rings 180, 185. Thus, end cap assembly 110 is prevented from disengaging pressure sleeve 115 as the pressure rises. Due to the tapered nature of collet collar 160 and collet plug 165, end cap assembly 110 grips pressure sleeve 115 increasingly tighter as fluid pressure within cylinder 100 increases. At the same time, end 800 of pressure sleeve 115 is gripped between clamping rings 180, 185. By securing pressure sleeve 115 to end cap assembly 110 at two interfaces, the load on pressure sleeve 115 is distributed and assembly 110 is prevented from crushing fabric 120 of pressure sleeve 115 and causing failure of pressure sleeve 115.

Figure 9A:
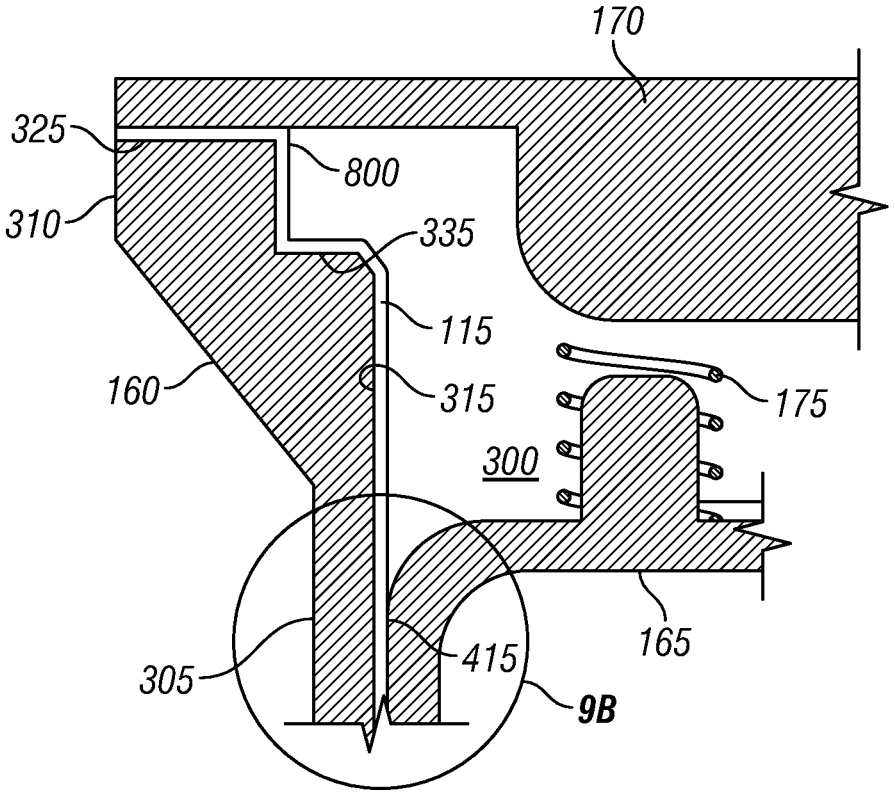
FIGS. 9A and 9B illustrate coupling of one end cap assembly to the pressure sleeve of the fluid-powered cylinder of FIG. 1A via bonding.
Figure 9B:
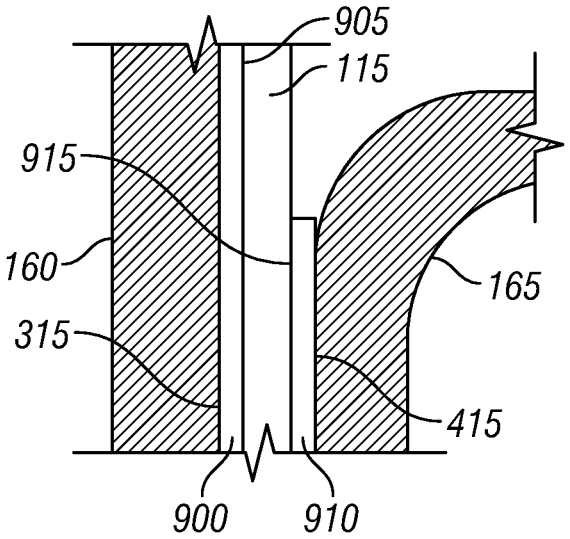

In alternative embodiments of cylinder 100, pressure sleeve 115 is coupled to collet collar 160 and collet plug 165 via bonding. In such embodiments, clamping rings 180, 185 and bolts 195 are not needed. Aside from these differences, cylinder 100, and its assembly, is essentially the same as described above. To couple end cap assembly 110 to pressure sleeve 115 via bonding, as illustrated by FIGS. 9A and 9B, a layer of bonding material 900 is applied to inner surface 315 of collet collar 160, including shoulder 335 and outer surface 325. End 800 of pressure sleeve 115 is inserted through end 305 (FIG. 3C) of collet collar 160 and central bore 300 to flanged end 310. Pressure sleeve 115 is then pressed against inner surface 315 to allow material 900 to adhere to pressure sleeve 115 and collet collar 160. When material 900 dries, a bond 905 is formed between collet collar 160 and pressure sleeve 115 at this interface.

Next, collet plug 165 is installed within end 800 of pressure sleeve 115 and collet collar 160. A layer of bonding material 910 is applied to outer surface 415 of collet plug 165. End 405 of plug 165 is then inserted into flanged end 310 of collet collar 160 and end 800 of pressure sleeve 115, such that outer surface 415 substantially aligns with inner surface 315 of collet collar 160 and in contact with end 800 of pressure sleeve 115 disposed therebetween. When material 910 dries, a bond 915 is formed between plug 165 and pressure sleeve 115 at this interface.

The length of collet collar 160 from end 305 to end 310 and the length of plug 165 from end 405 to end 410 are selected such that the shear loads at bonds 905, 915 do not cause these bonds 905, 915 to fail during operation of cylinder 100. In other words, these lengths are chosen such that the shear load resulting from pressurized fluid contained within cylinder 100 is distributed over sufficient area to prevent failure of bonds 905, 915. In some embodiments, these lengths are approximately four inches.

Figure 10:
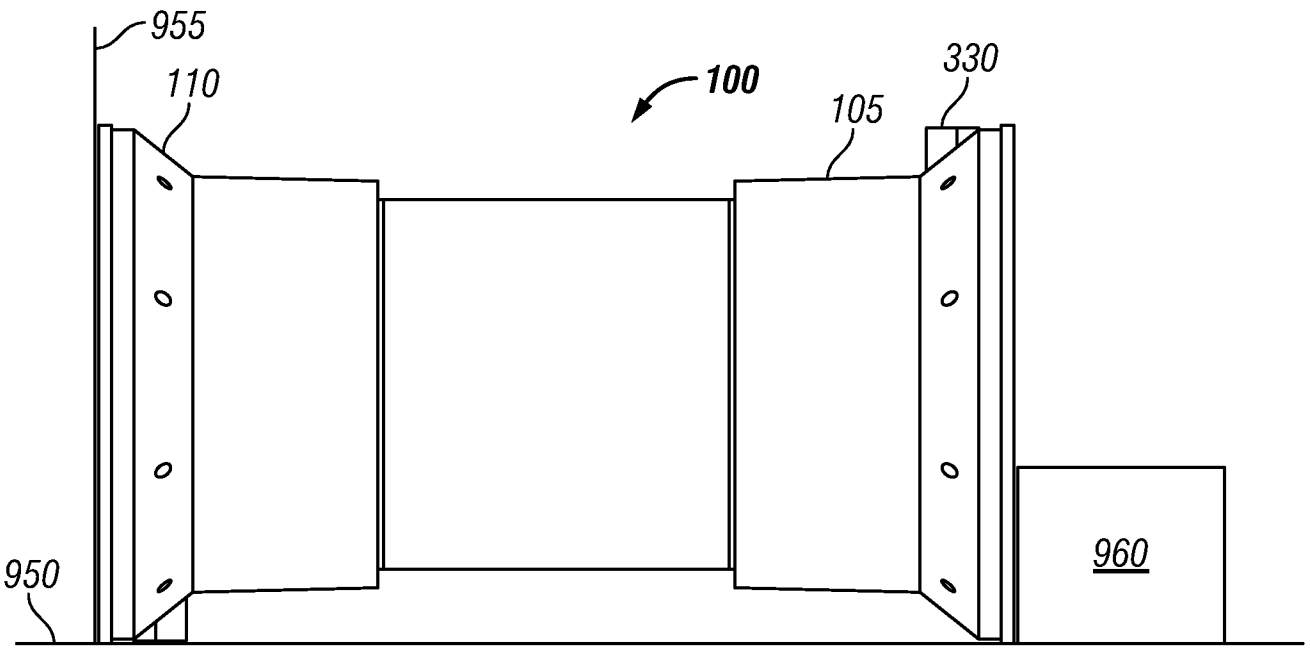
FIG. 10 depicts the fluid-powered cylinder of FIG. 1A oriented horizontally to displace an object.

Cylinder 100 is extendable longitudinally in virtually any direction to displace an object. For instance, as shown in FIG. 10, cylinder 100 may be positioned on its side and supported by a fixed surface 950 with end cap assembly 110 positioned against a fixed surface 955. When a fluid is injected into cylinder 100 through fluid port 330, cylinder 100 inflates and extends laterally or horizontally, defined relative to surface 950, thereby displacing an object 960 positioned adjacent end cap assembly 105 over surface 950.

Figure 11:
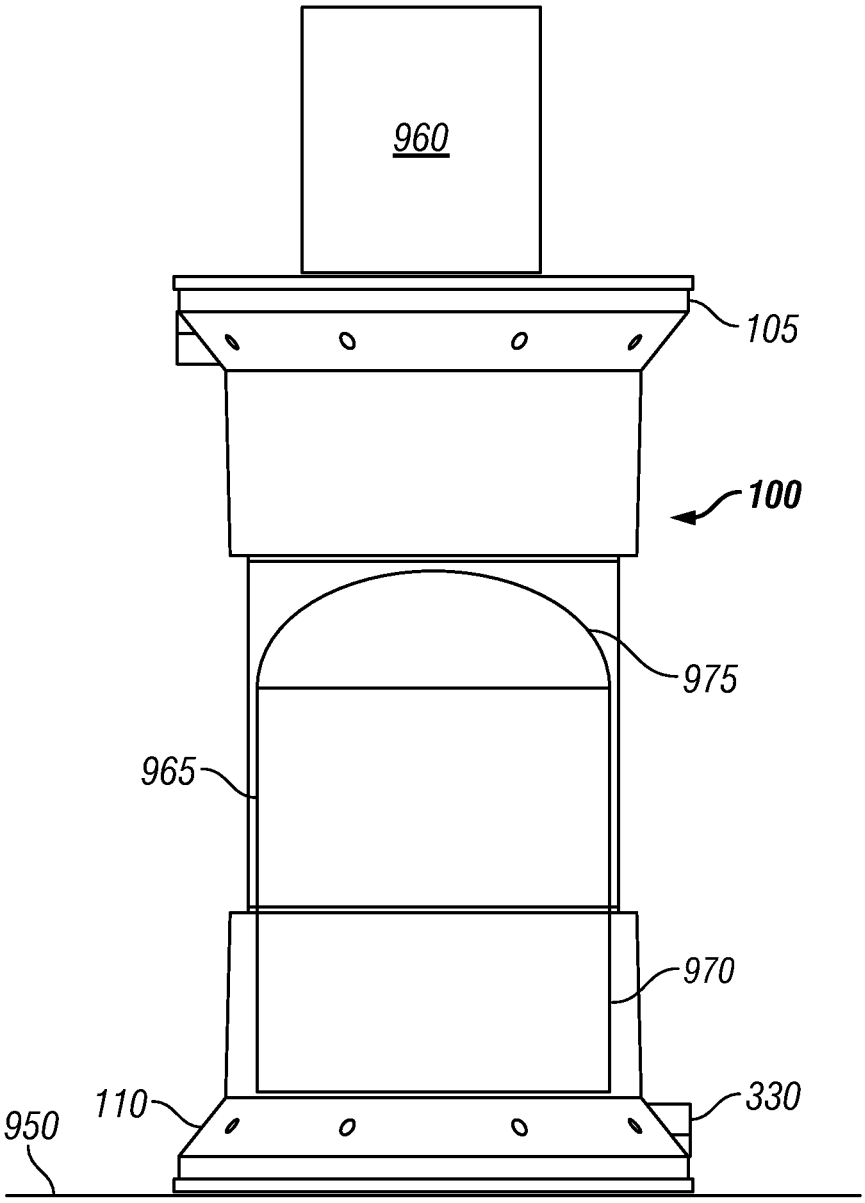
FIG. 11 depicts the fluid-powered cylinder of FIG. 1A oriented vertically to displace an object.

Alternatively, as shown in FIG. 11, cylinder 100 may be positioned on a fixed surface 950 such that when inflated, cylinder 100 extends vertically upward to displace an object 960. In such applications, cylinder 100 may further include a guide 965 disposed within cylinder 100. Guide 965 has a height slightly less than the relaxed or deflated height of cylinder 100 and is made of a rigid material, such as but not limited to plastic. In some embodiments, guide 965 includes a cylindrical body 970 with a hemispherical end cap 975 coupled thereto. Body 970 of guide 965 is coupled to end cap assembly 110, for example, by one or more bolts or other equivalent fastening means, to limit lateral movement of guide 965 relative to end cap assembly 110.

Guide 965 enables extension of cylinder 100 substantially in the vertical direction and prevents cylinder 100 from collapsing to one side or another due to the flexibility of fabric 120 of pressure sleeve 115, the weight of object 960, and the initial low pressure within pressure sleeve 115 at the onset of inflation. Further, the curved nature of hemispherical end cap 975 of guide 965 enables retraction of cylinder 100 in the substantially vertical direction as well. As fluid is vented from cylinder 100, the fabric 120 of pressure sleeve 115 slides downward over end cap 975 and cylinder 100 retracts about or around guide 965.

Figure 12:
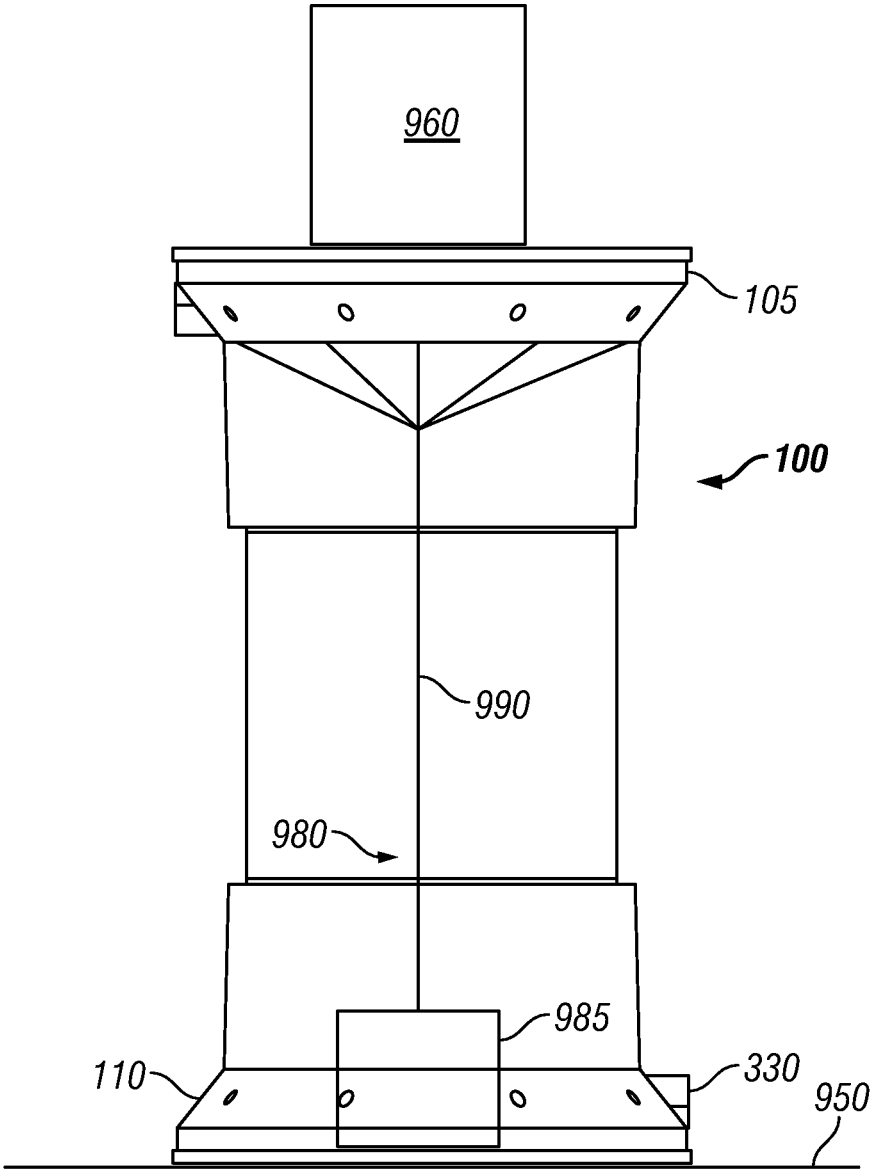
FIG. 12 depicts the fluid-powered cylinder of FIG. 1A with an internal winch system configured to constrain the cylinder along the longitudinal axis and to limit the extended length of the cylinder.

In the exemplary embodiments illustrated by FIGS. 10 and 11, the extended length of cylinder 100 is limited solely by the overall length of cylinder 100. However, in some instances, it may be desirable to inflate or extend cylinder 100 to only a fraction of its overall length. For example, it may be desirable to displace object 960 to a height of 20 feet, even though cylinder 100 is capable of extending to a length of 100 feet. In such applications, illustrated by FIG. 12, cylinder 100 further includes a length adjustment means that extends between the ends of cylinder 100 to control the longitudinal expansion of cylinder 100. One such means is a winch system 980 disposed within pressure sleeve 115 and coupled to end cap assembly 110, for example, by one or more bolts or other equivalent fastening means. Winch system 980 includes a winch 985 and a cable or line 990 extending therefrom and coupled to end cap assembly 105.

Winch 985 is configured to limit the length of cable 990 which may be dispensed therefrom, and thus the extended length of cylinder 100 when inflated. For example, winch 985 may be configured to allow only 20 feet of cable 990 to dispense. As a result, when cylinder 100 is inflated, the extended length of cylinder 100 is limited to the length of cable 990 allowed to be dispensed from winch 985, or 20 feet in the above example. When the length of cable 990 dispensed from winch 985 reaches its preset limit, cylinder 100 is prevented from further extension despite any continued injection of fluid into cylinder 100. Thus, the extended length of cylinder 100 is limited to 20 feet, for example, although cylinder 100 may be capable of extending further, such as to 100 feet. In these embodiments, a relief valve, such as relief valve 925 described in reference to FIG. 13, may be coupled to fluid port 330 to enable fluid pressure relief and prevent over-pressurization of cylinder 100.

Winch 985 may be further configured to allow cable 990 to extend therefrom only when the pressure of fluid within cylinder 100 exceeds a minimum level. As such, the pressure within cylinder 100 may be controlled and remain substantially constant as cylinder 100 extends to its preset limit. By controlling the pressure within cylinder 100 in this manner, cylinder 100 both displaces and supports object 960. Further, winch 985 eliminates the need for guide 965, described with reference to FIG. 11.

Figure 13:
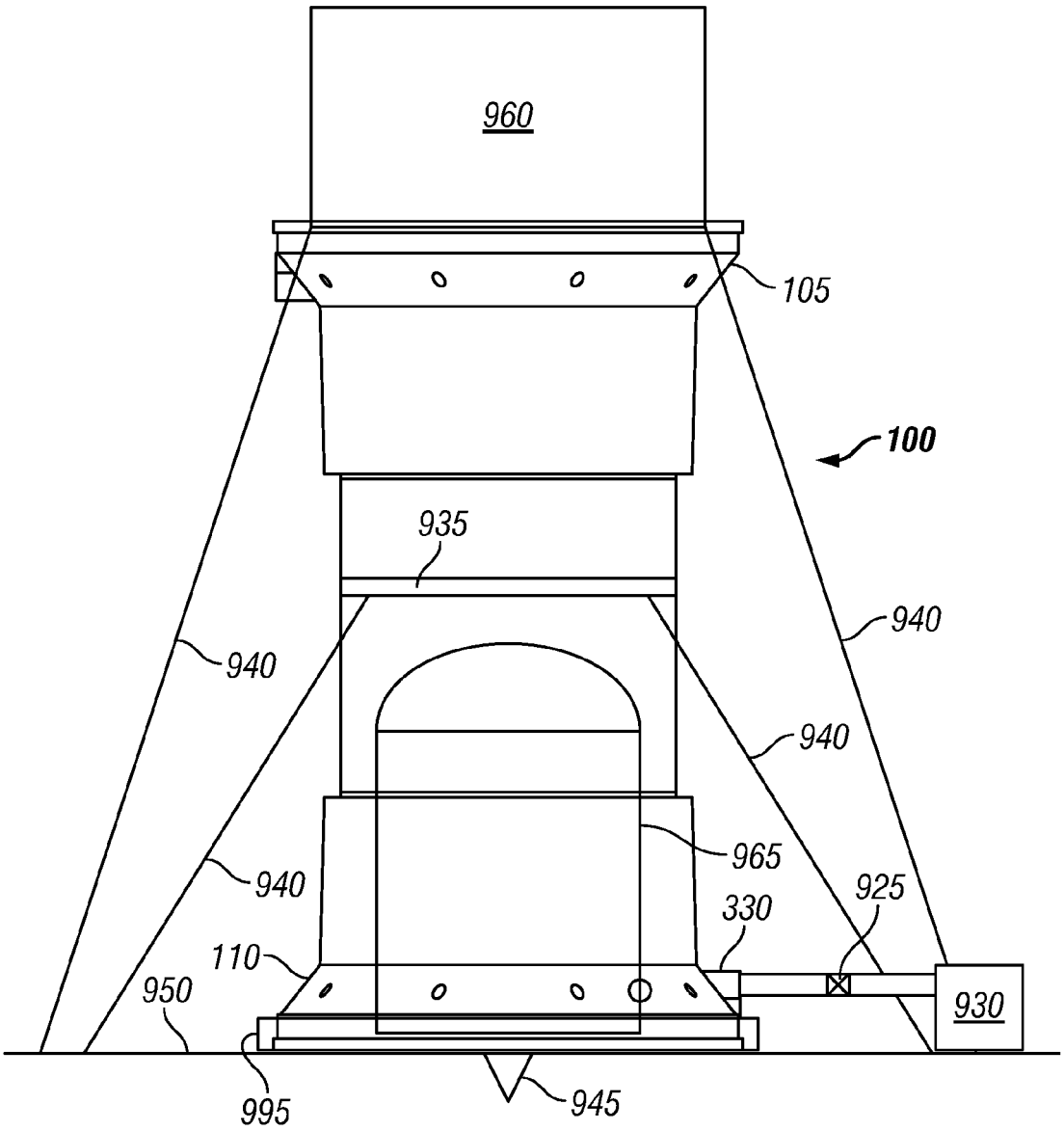
FIG. 13 depicts the fluid-powered cylinder of FIG. 1A in operation.

To operate cylinder 100, as illustrated by FIG. 13, cylinder 100 is moved from its storage location to a location where an object 960 is to be displaced. At the site of operation, cylinder 100 is positioned such that end cap assembly 110, which includes fluid port 330, is coupled to a fixed surface 950. This orientation provides easy access to fluid port 330, allowing cylinder 100 to be conveniently filled and emptied through port 330.

In some embodiments, including those illustrated by FIG. 13, fixed surface 950 is the ground, and cylinder 100 is positioned within a bucket-shaped device 995 which is secured to the ground 950 by a spear 945 extending from bucket 995 into the ground 950, or other equivalent means. Bucket 995 limits translational movement of cylinder 100 relative to ground 950 and prevents toppling of cylinder 100, perhaps due to wind, as cylinder 100 is operated.

Object 960 is then positioned on end cap assembly 105 and may be coupled thereto to prevent movement of object 960 as cylinder 100 is inflated and extended. Cylinder 100 may in some embodiments include a lateral support member that extends from the cylinder 100 to the ground 950 to secure the cylinder laterally. One such means is a plurality of guy wires 940 coupled between cylinder 100 and the ground 950. In order to avoid coupling such guy wires 940 directly to pressure sleeve 115 of cylinder 100, cylinder 100 includes a fabric loop 935 extending at least in part around its circumference. One or more of guy wires 940 are coupled between fabric loop 935 and ground 950.

A fluid source 930 is coupled to fluid port 330. Fluid source 930 provides fluid to cylinder 100 to inflate and extend cylinder 100, thereby displacing object 960 to a desired height. In some embodiments, fluid source 930 is an air pump. A check valve and/or pressure relief valve 925 may be disposed between fluid source 930 and fluid port 330 to control fluid flow into/out of cylinder 100 and the pressure of fluid contained therein.

Once positioned and coupled to fluid source 930, fluid source 930 may then be activated to fill cylinder 100. Fluid then flows through fluid port 330 and flowbores 425 (FIG. 4B) of collet plug 165 into pressure sleeve 115. As cylinder 100 is filled, end cap assembly 105, with object 960 coupled thereto, is displaced. When object 960 is displaced to the desired location or height, filling of cylinder 100 is discontinued. Due to the fluid-tight nature of bladder 140 (FIG. 1C) and the ability to add fluid through port 330 as desired or when needed, cylinder 100 may remain in this extended configuration, and object 960 in this displaced position, indefinitely.

When it is desired to lower object 960, fluid port 330 is opened. Pressurized fluid contained within cylinder 100 is exhausted from cylinder 100 through port 330 and valve 925 to the atmosphere or to a reclamation system (not shown) coupled thereto for subsequent reuse. Due to the flexible nature of fabric 120 of pressure sleeve 115, cylinder 100 gradually collapses under its own weight as fluid is exhausted from cylinder 100.

To assist cylinder 100 as it collapses, a pump (not shown) may be coupled to valve 925. The pump may then be activated to provide a partial vacuum on cylinder 100 and thereby assist the collapse of cylinder 100. Once collapsed and empty, cylinder 100 may be stored in a storage space that is only a fraction of the space occupied by cylinder 100 when filled. Alternatively or additionally, a cord or line may be coupled to cylinder 100 prior to expanding cylinder 100 to displace object 960. When cylinder 100 is collapsed to lower object 960, a tension load may be applied to the cord to assist the collapse of cylinder 100.

Although pressure sleeve 115 is shown in the figures and described as cylindrically shaped, pressure sleeve 115 may assume other shapes having noncircular cross-sections, such as but not limited to rectangular, square, or oval. Aside from having a noncircular cross-section, construction, assembly and operation of cylinder 100 remains substantially the same as described above. Further, while operation of cylinder 100 is described in the context of displacing an object using a single cylinder 100, more than one cylinder 100 may be arranged to displace an object. For instance, two or more cylinders 100 may be oriented in series, for example, one stacked on top of the other. The uppermost cylinder 100 would then be inflated to displace the object. When that cylinder 100 is inflated to its maximum length, the adjacent cylinder 100 is next inflated to its maximum length, and so on until the object is displaced to the desired height. Further, two or more cylinders 100 may be arranged side by side to displace a single relatively large and/or heavy object, the size and/or weight of which is beyond the capacity of a single cylinder 100. In such applications, the two or more cylinders 100 would preferably be inflated at approximately the same rate to uniformly displace the object.

While various preferred embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. An apparatus for displacing an object with respect to a support surface, the apparatus comprising:

a first end cap assembly adapted to abut the support surface;

a second end cap assembly adapted to displace the object;

a fabric enclosure comprising ends fastened to the first and second end cap assemblies and forming a chamber;

the chamber comprising a port for selectively disposing an incompressible fluid in the chamber;

the chamber being extendable to displace the object to a first position with respect to the support surface and collapsible to displace the object to a second position with respect to the support surface; and at least one of the first and second end cap assemblies comprising:

a collet collar comprising an inner surface tapering in from the end of the enclosure;

a collet plug comprising an outer surface tapering in from the end of the enclosure;

wherein the collet collar is placed around and secured to the end of the enclosure;

wherein the collet plug is inserted inside the end of the enclosure and within the collet collar such that the enclosure is gripped between the collet collar inner surface and the collet plug outer surface at a location spatially separate from where the enclosure is secured to the collet collar; and wherein increased pressure within the enclosure acting on the collet collar causes the enclosure to be gripped increasingly tighter between the collet collar and the collet plug.

2. The apparatus of claim 1, further comprising a guide disposed within the chamber to guide the extending and collapsing of the chamber in a direction substantially parallel to a longitudinal axis of the chamber.

3. The apparatus of claim 1, further comprising a length adjustment member to adjust the extending of the chamber and the displacement of the object.

4. The apparatus of claim 1, wherein the port extends through either the first or second end cap to the chamber.

5. The apparatus of claim 1, wherein the fabric of the enclosure is braided or woven and coated to be impermeable to fluid.

6. The apparatus of claim 1, further comprising a lateral support member to support the chamber laterally when the chamber displaces the object to the first position and displaces the object to the second position.

7. An apparatus for displacing an object, the apparatus comprising:

a first end cap assembly and a second end cap assembly;

a sleeve comprising ends fastened to the first and second end cap assemblies, the sleeve comprising fabric and coated over an inner surface thereby forming a bladder that is impermeable to fluid;

a closeable fluid port extending through one of the first and the second end cap assemblies, the fluid port configured to allow fluid communication with the bladder;

wherein each of the first and the second end cap assemblies comprises:

a collet collar comprising an inner surface tapering in from the respective end of the sleeve;

a collet plug comprising an outer surface tapering in from the end of the sleeve;

wherein the collet collar is placed around and secured to the end of the sleeve;

wherein the collet plug is inserted inside the end of the sleeve and within the collet collar such that the sleeve is gripped between the collet collar inner surface and the collet plug outer surface at a location spatially separate from where the sleeve is secured to the collet collar; and wherein increased pressure within the sleeve acting on the collet collar causes the sleeve to be gripped increasingly tighter between the collet collar and the collet plug.

8. The apparatus of claim 7, further comprising a guide disposed within the bladder, the guide configured to enable extension and collapsing of the bladder in a direction substantially parallel to a longitudinal axis through the bladder.

9. The apparatus of claim 8, wherein the guide comprises a cylindrical body and a hemispherical cap extending therefrom.

10. The apparatus of claim 9, wherein the guide is coupled to one of the first and the second end cap assemblies.

11. The apparatus of claim 7, further comprising a winch system disposed within the bladder, the winch system configured to limit the filled length of the bladder.

12. The apparatus of claim 11, wherein the winch system comprises a winch and a cable extending therefrom, wherein the cable is coupled to one of the first and the second end cap assemblies and wherein the winch is configurable to limit the length of the cable which is dispensed therefrom.

13. The apparatus of claim 12, wherein the winch is further configured to dispense the cable when the pressure of fluid within the enclosure exceeds a predetermined level.

14. The apparatus of claim 7, wherein the sleeve is seamless.

15. The apparatus of claim 7, wherein the at least one of the first and the second end cap assemblies further comprises:

the collet collar comprising a flanged end; and a plate coupled to the flanged end of the collet collar.

16. The apparatus of claim 15, wherein the collet collar is bonded to an outer surface of the end of the sleeve.

17. The apparatus of claim 15, wherein the collet plug is bonded to an inner surface of the end of the sleeve.

18. The apparatus of claim 15, wherein the plate further comprises a plurality of ribs extending substantially normally therefrom.

19. The apparatus of claim 15, wherein the collet plug comprises a plurality of extensions with a compressible member disposed on each extension, wherein the compressible members are compressed between the collet plug and the plate.

20. The apparatus of claim 19, wherein the compressible members are springs.

21. The apparatus of claim 15, wherein the inner surface of the collet collar is configured to limit movement of the collet plug due to load imparted from compressible members.

22. The apparatus of claim 7, wherein each of the first and the second end cap assemblies further comprises:

inner clamping ring inserted into the end of the sleeve; and an outer clamping ring coupled to the inner clamping ring with the end of the sleeve positioned therebetween.

23. The apparatus of claim 7, wherein the fabric is braided or woven.

24. A method for displacing an object with respect to a support surface, the method comprising:

forming an extendable/collapsible enclosure comprising a sleeve secured to end cap assemblies at the ends of the sleeve;

positioning the enclosure between the object and support surface;

injecting a fluid through a fluid port in the enclosure to extend the enclosure;

guiding the extension of the enclosure in a longitudinal direction;

extending enclosure as fluid accumulates in the enclosure; and displacing the object from a first position to a second position as the enclosure extends;

gripping the sleeve with the end cap assemblies at locations other than the ends of the sleeve; and increasing the grip of the end cap assemblies on the sleeve other than at the ends by increasing fluid pressure inside the enclosure.

25. The method of claim 24, further comprising coupling one end of the enclosure to the support surface.

26. The method of claim 25, further comprising coupling the object to another end of the enclosure.

27. The method of claim 24, wherein guiding the extending and collapsing of the enclosure further comprises positioning a support structure within the enclosure, the support structure configured to provide support to the enclosure.

28. The method of claim 24, further comprising ceasing to inject fluid when the object is displaced to the desired location.

29. The method of claim 24, further comprising exhausting fluid from the enclosure, wherein the enclosure collapses and the object is displaced.

30. The method of claim 24, further comprising coupling a winch system to the enclosure, the winch system configured to limit the extended length of the enclosure.

31. The method of claim 24, wherein the sleeve comprises a fabric.

* * * * *